US012024829B2

(12) United States Patent
Behn

(10) Patent No.: US 12,024,829 B2
(45) Date of Patent: Jul. 2, 2024

(54) STRESS CONCENTRATOR FOR AN ANGLED SCRAPER

(71) Applicant: Caterpillar Paving Products Inc., Brooklyn Park, MN (US)

(72) Inventor: Mark Daniel Behn, St. Michael, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 440 days.

(21) Appl. No.: 17/365,109

(22) Filed: Jul. 1, 2021

(65) Prior Publication Data

US 2023/0002980 A1 Jan. 5, 2023

(51) Int. Cl.
*E01C 19/23* (2006.01)

(52) U.S. Cl.
CPC ..... *E01C 19/238* (2013.01); *E01C 19/236* (2013.01)

(58) Field of Classification Search
CPC ..... E01C 19/236; E01C 19/238; E02D 3/026
USPC ..... 404/121, 129
See application file for complete search history.

(56) References Cited

U.S. PATENT DOCUMENTS

| | | | | | |
|---|---|---|---|---|---|
| 1,837,946 | A * | 12/1931 | Bosch | B60S 1/68 | 280/855 |
| 1,875,252 | A * | 8/1932 | Meyer | B60S 1/68 | 24/69 TT |
| 1,942,655 | A * | 1/1934 | McCormick | B60S 1/68 | 404/129 |
| D290,613 | S * | 6/1987 | Ryan | D15/29 | |
| 4,858,699 | A * | 8/1989 | Poltrock | A01B 15/16 | 172/558 |
| 5,360,288 | A * | 11/1994 | O'Neill | E02D 3/026 | 404/121 |
| 5,511,901 | A * | 4/1996 | Yates | E01C 19/236 | 404/124 |
| 9,033,613 | B2 * | 5/2015 | Dykhnich | E01C 19/238 | 404/121 |
| 9,611,604 | B2 | 4/2017 | Vigneault | | |
| 9,670,628 | B2 * | 6/2017 | Bletscher | E02D 3/026 | |
| 10,024,004 | B1 | 7/2018 | Oetken et al. | | |
| 10,030,341 | B1 | 7/2018 | Burger | | |
| 10,036,129 | B2 | 7/2018 | Oetken et al. | | |
| 10,507,804 | B1 * | 12/2019 | Chandler | E02D 3/0265 | |
| 11,001,123 | B2 | 5/2021 | Guethle et al. | | |
| 2007/0261573 | A1 * | 11/2007 | Cameron | B08B 1/00 | 100/174 |
| 2013/0115001 | A1 * | 5/2013 | Von Vett | E02D 3/026 | 404/129 |
| 2020/0307526 | A1 * | 10/2020 | Guethle | E02D 3/026 | |

FOREIGN PATENT DOCUMENTS

| | | | | |
|---|---|---|---|---|
| EP | 2009180 | A1 | 12/2008 | |
| FR | 3094312 | * | 10/2020 | B60S 1/68 |

* cited by examiner

*Primary Examiner* — Raymond W Addie

(57) ABSTRACT

A scraper used with a compactor wheel assembly includes an attachment portion, a scraping portion that forms a first oblique angle with the attachment portion, and a transition portion connecting the scraping portion to the attachment portion. The transition portion defines a stress concentrator for allowing the scraper to break before any structure to which the scraper is attached is damaged.

20 Claims, 14 Drawing Sheets

STRESS CONCENTRATOR FOR AN ANGLED SCRAPER

TECHNICAL FIELD

The present disclosure relates generally to compactor machines, and, more specifically, to cleaner fingers for cleaning debris from between adjacent rows of compactor pads or cleats disposed on an outer surface of a compactor wheel.

BACKGROUND

A compactor is a type of self-propelled work machine that may be used in a variety of applications, such as compacting fill dirt on a construction site or compacting debris in a landfill. Landfill compactors crush and compact waste and refuse to reduce the size and bulk of the material in order to maximize the landfill's available capacity. To obtain maximum compaction and crushing of refuse and other materials, a typical landfill compactor will include specialized drum with a number of rigid compactor pads or cleats. The compactor pads are circumferentially mounted on the outer surface of the compactor wheels, and are arranged in rows that are generally evenly spaced longitudinally across the outer surface. During operation, residual waste and other materials such as soil can collect on the wheels and between the compactor pads, impeding subsequent compacting. To remove the residual material or soil, a cleaner finger assembly is typically used. The cleaner finger assembly, which includes a number of individual cleaner fingers, is mounted to the compactor proximate the wheel. As the wheel rotates, the cleaner fingers scrape residual material from between the rows of compactor pads or cleats.

U.S. Pat. No. 11,001,234 discloses a notched compactor cleaner finger. However, the cleaner finger is straight and has a consistent thickness.

As can be seen, there still exists a need for a cleaner finger system that avoids costly repair in situations where the cleaner finger is not straight or does not have a consistent thickness.

SUMMARY

A scraper for use with a compactor wheel assembly is provided according to an embodiment of the present disclosure. The scraper may comprise an attachment portion, a scraping portion, and a transition portion connecting the scraping portion to the attachment portion. The transition portion may define a stress concentrator.

A replacement kit for a cleaner finger assembly is provided according to an embodiment of the present disclosure. The kit may comprise a scraper including an attachment portion defining an elongated fastener receiving slot, a scraping portion that forms a first oblique angle with the attachment portion, and a transition portion connecting the scraping portion to the attachment portion, the transition portion defining a stress concentrator. The attachment portion may include a rectangular configuration defining a length and a width that is less than the length. The elongated fastener receiving slot may run parallel with the length of the attachment portion, and may define a slot width. A top mounting block may also be provided that defines a top mounting block width that is greater than the slot width, and may define two apertures that extend through the top mounting block.

A compactor wheel assembly according to an embodiment of the present disclosure may comprise a yoke subassembly, a compactor drum subassembly that is rotatably attached to the yoke assembly about an axis of rotation, and a scraper subassembly that is attached to the yoke subassembly proximate to the compactor drum subassembly. The scraper subassembly may include a plurality of scrapers, each of the plurality of scrapers including an attachment portion, a scraping portion that forms a first oblique angle with the attachment portion, and a transition portion connecting the scraping portion to the attachment portion. The transition portion may define a stress concentrator.

BRIEF DESCRIPTION OF THE DRAWINGS

The accompanying drawings, which are incorporated in and constitute a part of this specification, illustrate several embodiments of the disclosure and together with the description, serve to explain the principles of the disclosure. In the drawings.

DETAILED DESCRIPTION

Figure 1:
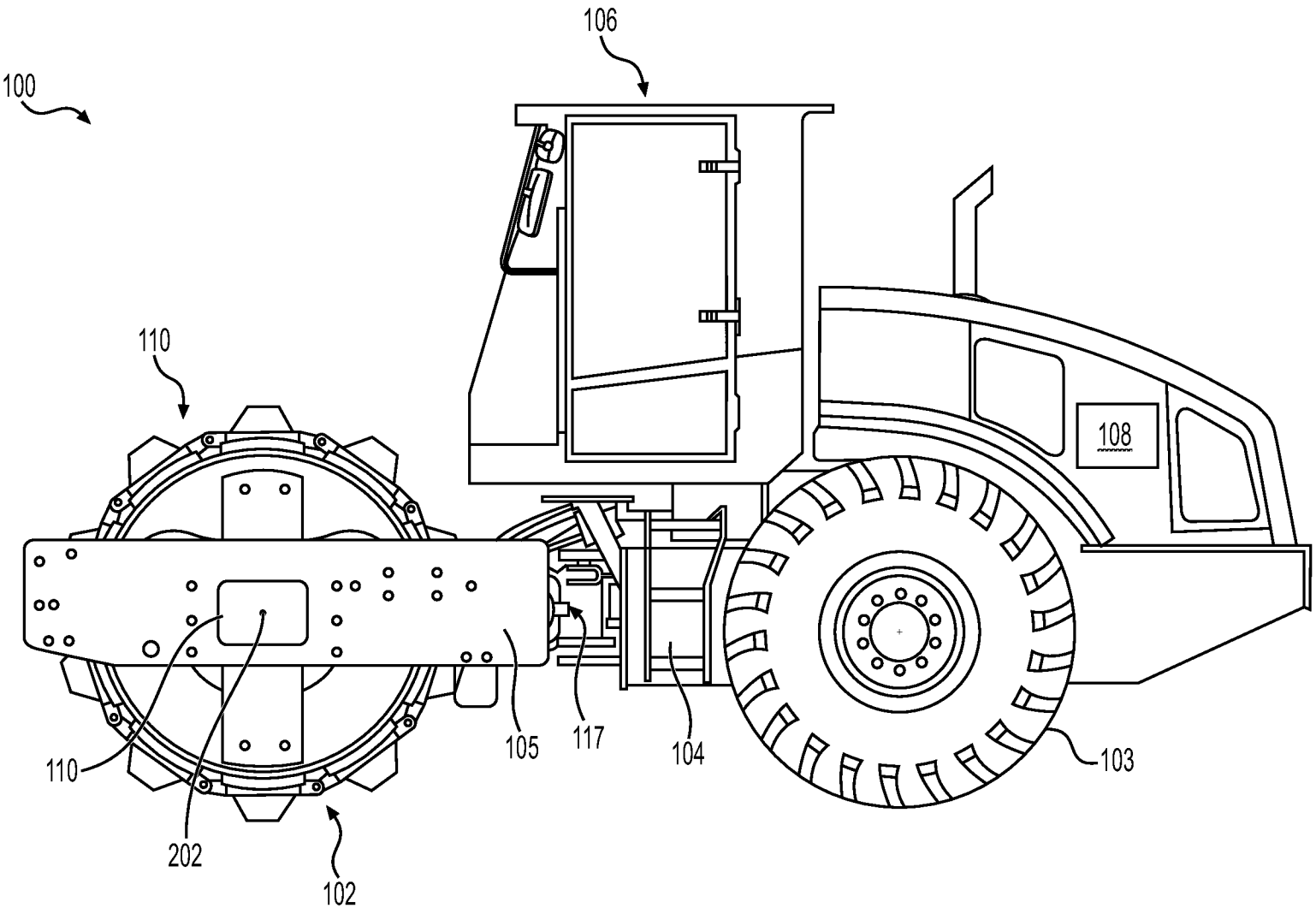
FIG. 1 is a side view of a compacting machine that may use a drum assembly with a cleaner finger assembly having cleaner fingers configured according to an embodiment of the present disclosure.

Reference will now be made in detail to embodiments of the disclosure, examples of which are illustrated in the accompanying drawings. Wherever possible, the same reference numbers will be used throughout the drawings to refer to the same or like parts. In some cases, a reference number will be indicated in this specification and the drawings will show the reference number followed by a letter for example, 100*a*, 100*b* or by a prime for example, 100', 100" etc. It is to be understood that the use of letters or primes immediately after a reference number indicates that these features are similarly shaped and have similar function as is often the case when geometry is mirrored about a plane of symmetry. For ease of explanation in this specification, letters and primes will often not be included herein but may be shown in the drawings to indicate duplications of features, having similar or identical function or geometry, discussed within this written specification.

A scraper of a drum associated with a work machine, such as a vibratory soil compactor, is disclosed. The scraper includes a geometric feature, which may be disposed on a bottom/top/side surface or combination thereof. Further, the geometric feature may be a hole or may be a round shape, V notch, square notch, or other variable geometry. Also, a different combination of geometric features may be used on the scraper. The geometric feature may be tuned for a desired loading condition, geometry, material, manufacturing method of the scraper, and/or a supporting structure. The geometric feature may allow the scraper to fracture at a point just prior to an event when damage may occur in a supporting scraper mounting structure, thereby minimizing the cost of repair. That is to say, it may be less expensive to replace the scraper than to repair the scraper mounting structure.

An exemplary embodiment of a compactor machine 100 is shown generally in FIG. 1. The compactor machine 100 shown in the FIG. 1 is a smooth drum type soil compactor with a drive on shell kit or a plurality of pads or cleats installed onto it installed. The compactor machine 100 may be used at a job site, such as a construction site, to compact materials, and may generally include a smooth compactor drum, or other similar ground engaging elements, such as a drum having cleats, or pads. In the illustrated embodiment, the compactor machine 100 includes a compactor wheel assembly 102 and tires 103 as the ground engaging elements.

The compactor drum wheel assembly 102 includes a yoke subassembly 105 of the compactor machine 100. The compactor wheel assembly 102 may be used to crush materials, such as, for example, soil, as the compactor machine 100 is moved throughout the work site. The machine includes a cab or otherwise known as an operator control station 106. The compactor machine 100 may also include an engine 108, such as an internal combustion engine, and a variety of mechanical, hydraulic and/or electrical systems for performing known functions. Such components and/or systems are well known to those skilled in the art and, therefore, will not be discussed herein in greater detail.

Figure 2:
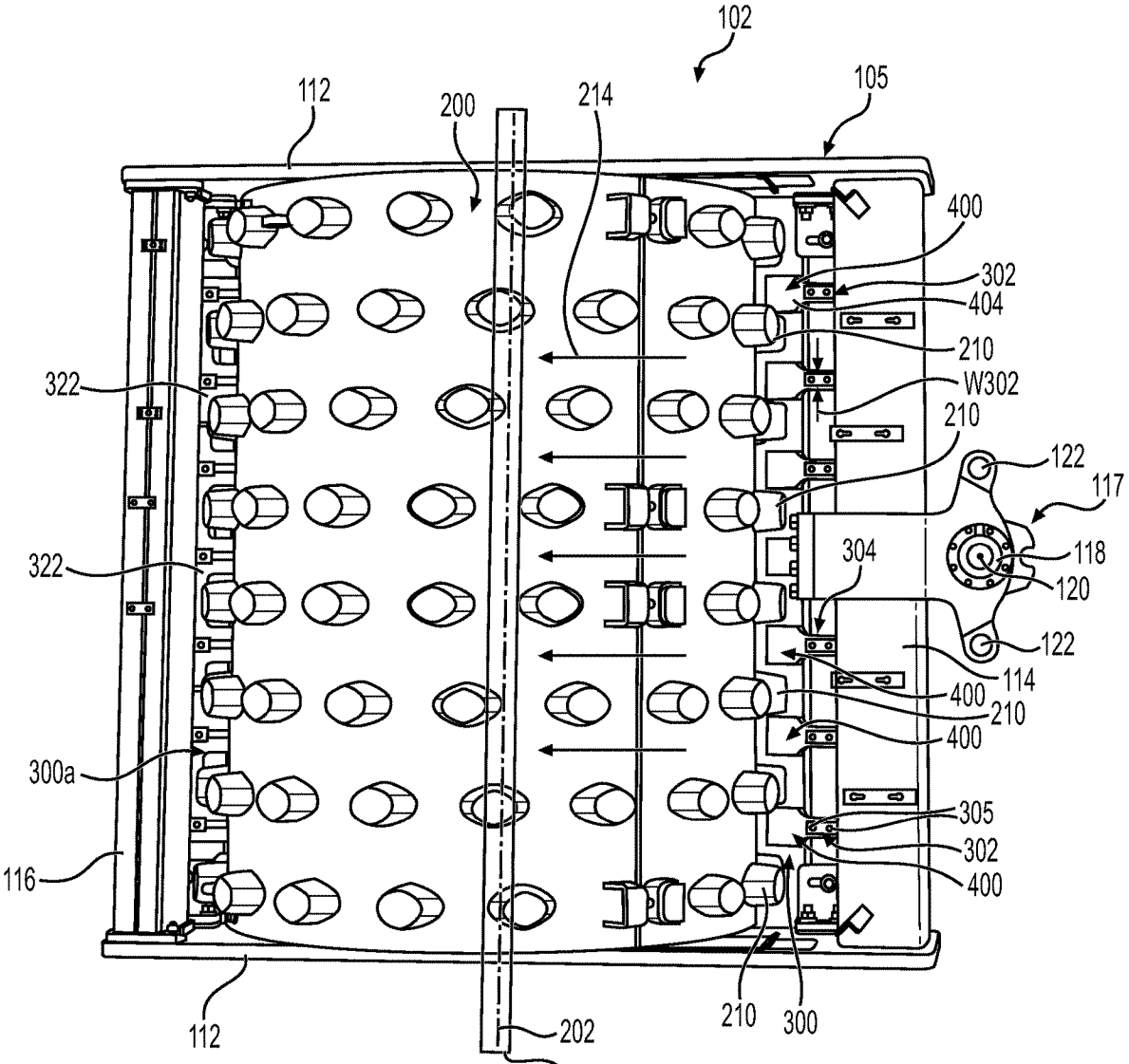
FIG. 2 is a top view of the drum assembly of FIG. 1 removed from the compacting machine of FIG. 1.
Figure 3:
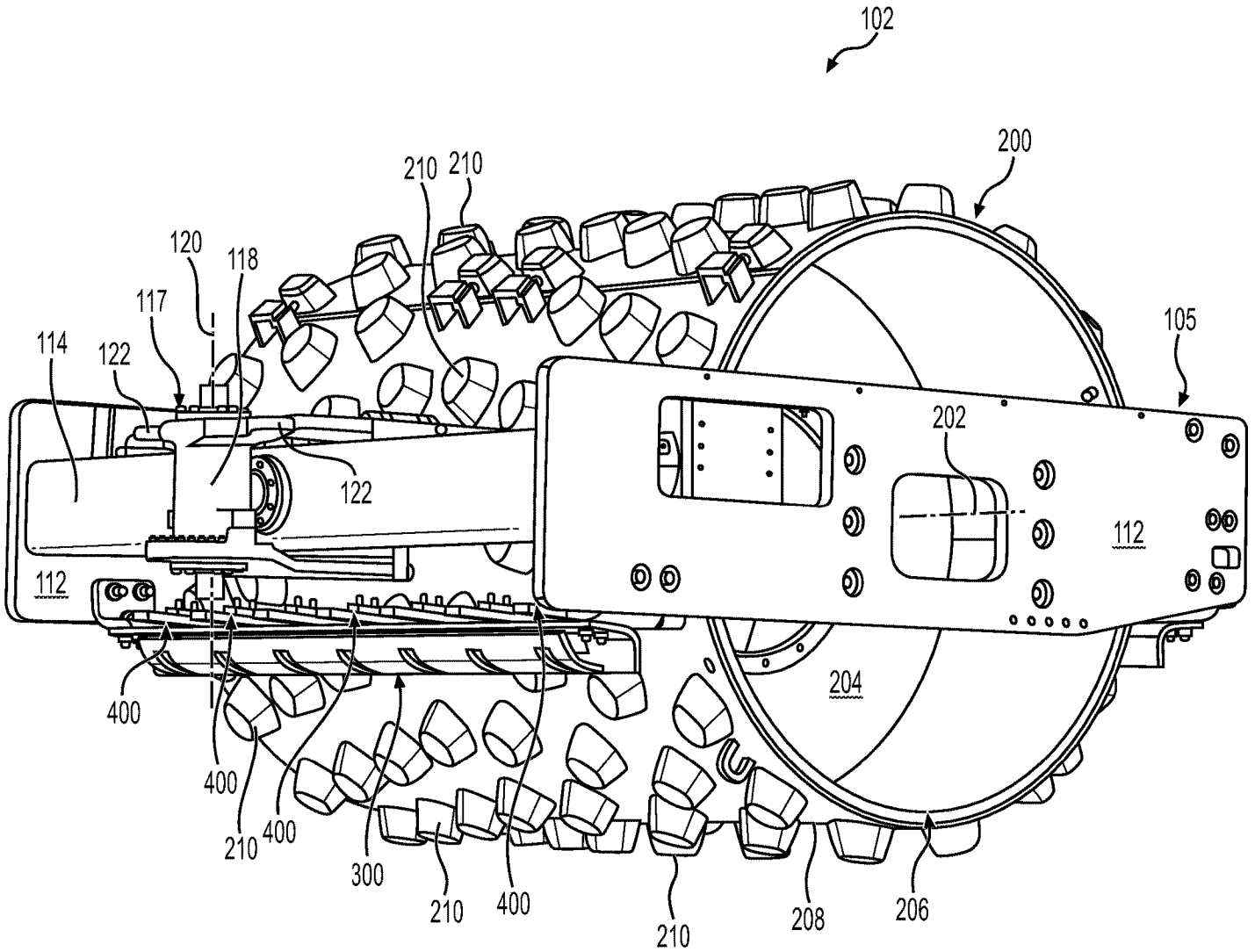
FIG. 3 is a perspective view of the drum assembly of FIG. 1.
Figure 4:
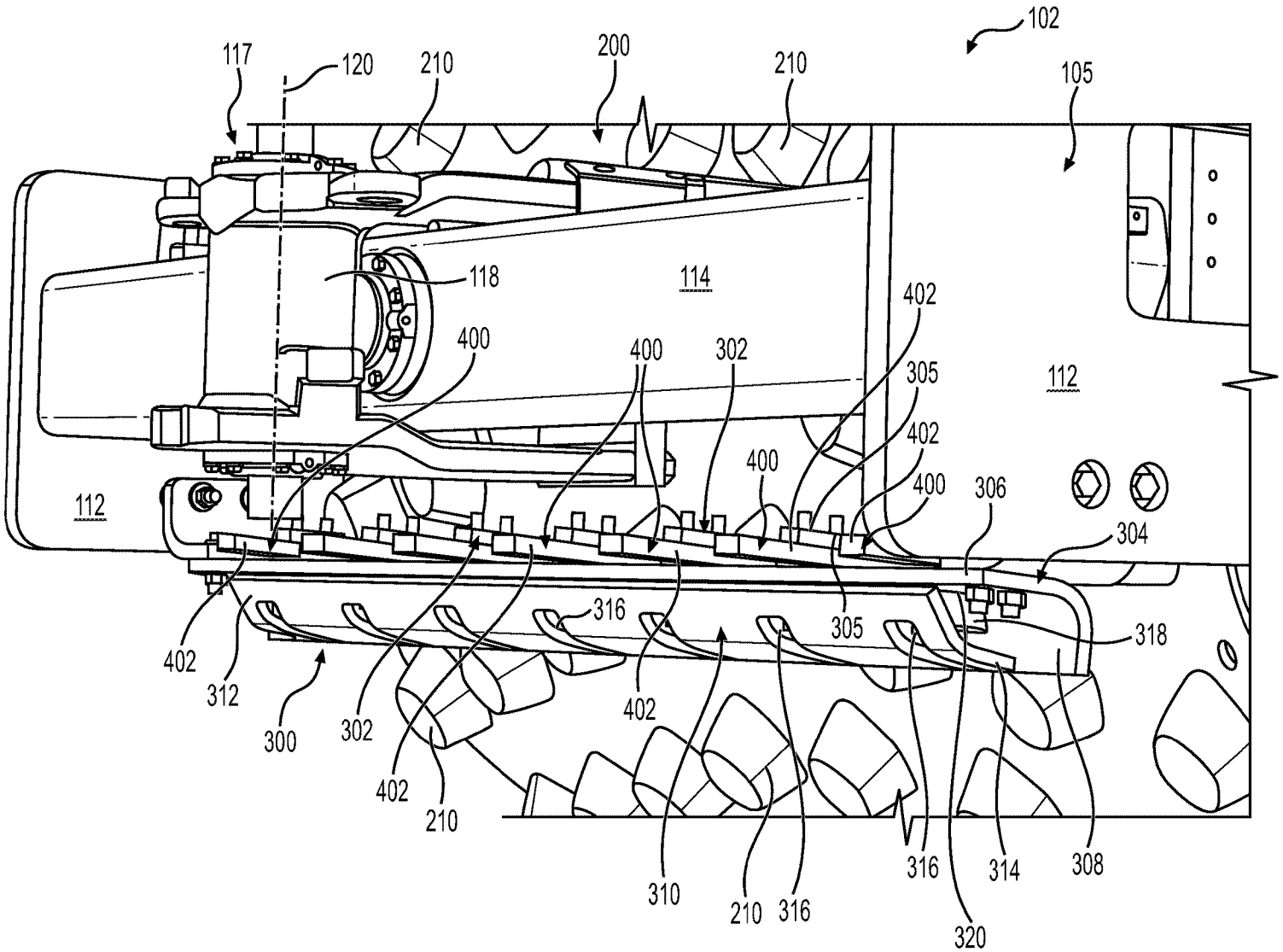
FIG. 4 is an enlarged detail view of the drum assembly of FIG. 3.
Figure 16:
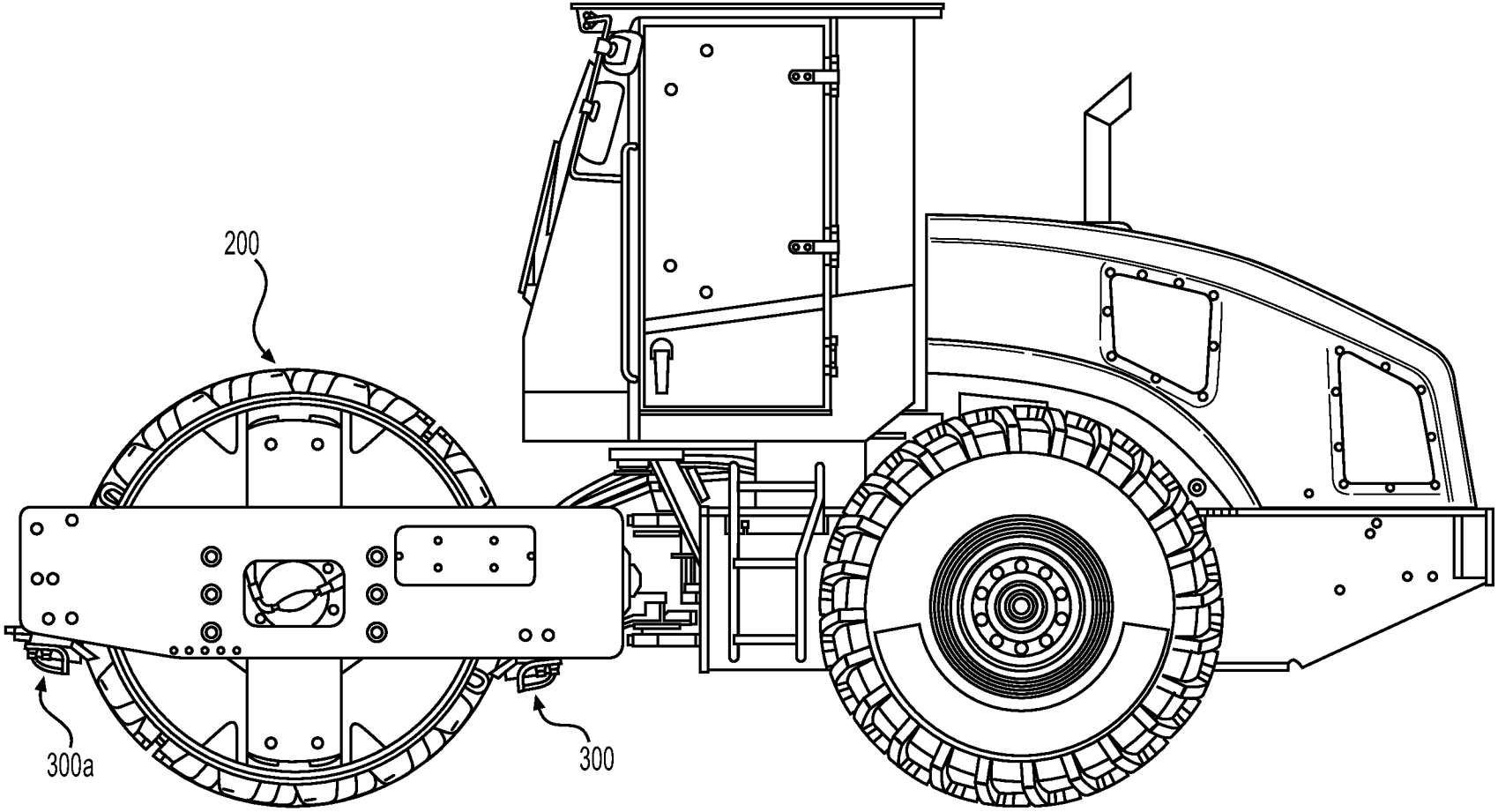
FIG. 16 is an alternate view of a machine that may employ various embodiments of the present disclosure.

Focusing now on FIGS. 2 thru 4, the compactor wheel assembly 102 may comprise a yoke subassembly 105 as previously mentioned herein, as well as a compactor drum subassembly 200 that is rotatably attached to the yoke subassembly 105 about an axis of rotation 202, which is formed by the axle subassembly 110 shown in FIG. 1 or FIG. 16. A scraper subassembly 300 may be attached to the yoke subassembly 105 proximate to the compactor drum subassembly 200.

The scraper subassembly 300 includes a plurality of scrapers 400, each of the plurality of scrapers 400 including an attachment portion 402 (see also FIGS. 5, 8 thru 10), a scraping portion 404 that forms a first oblique angle 406 with the attachment portion 402, and a transition portion 408 connecting the scraping portion 404 to the attachment portion 402.

As best seen in FIGS. 8 thru 15, the transition portion 408, 508, 608, 708, may define a stress concentrator 410, 510, 610, 710. Different configurations of these various embodiments of a stress concentrator will be discussed later herein.

Figure 5:
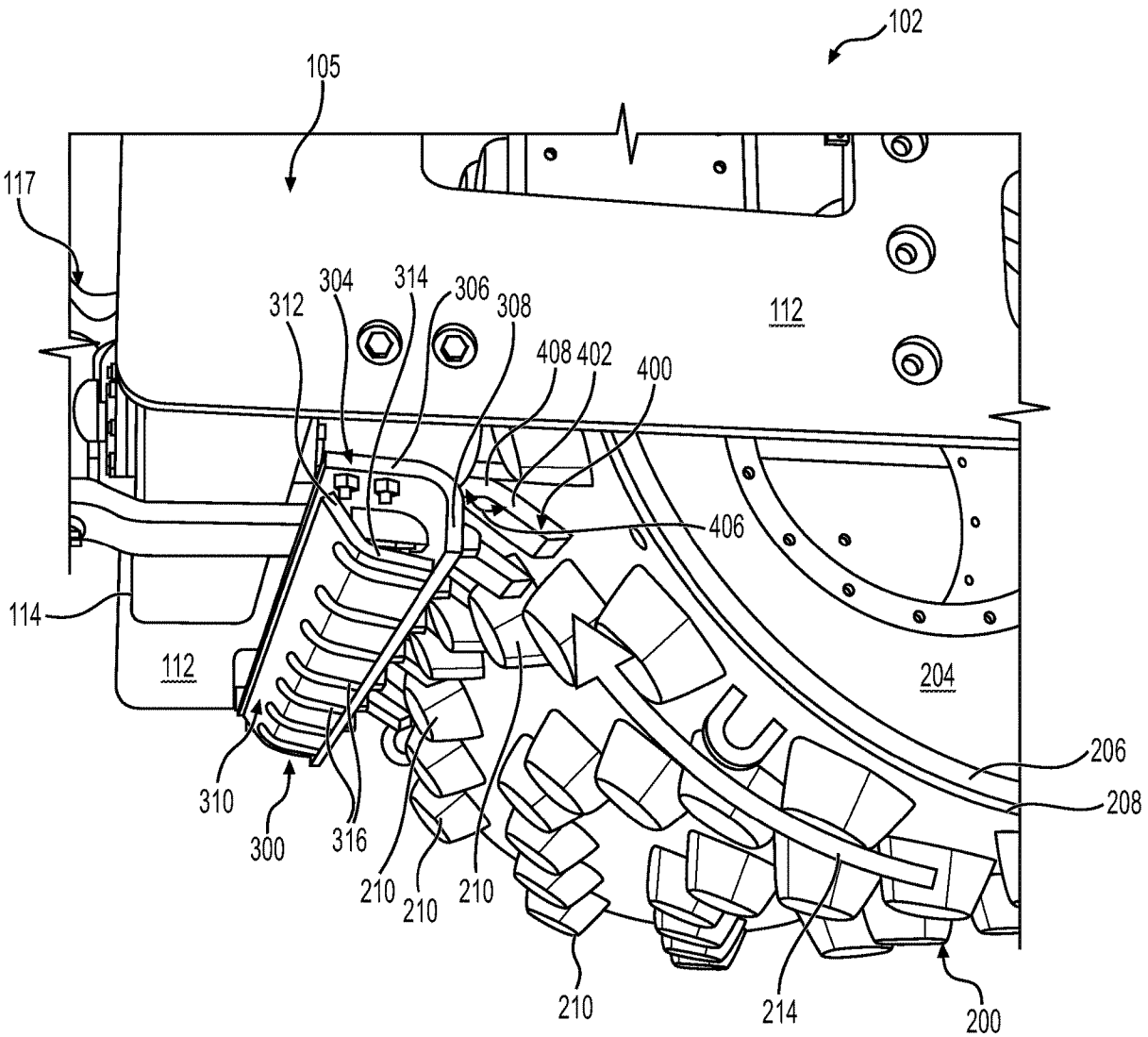
FIG. 5 is a bottom oriented perspective view of drum assembly of FIG. 4.
Figure 6:
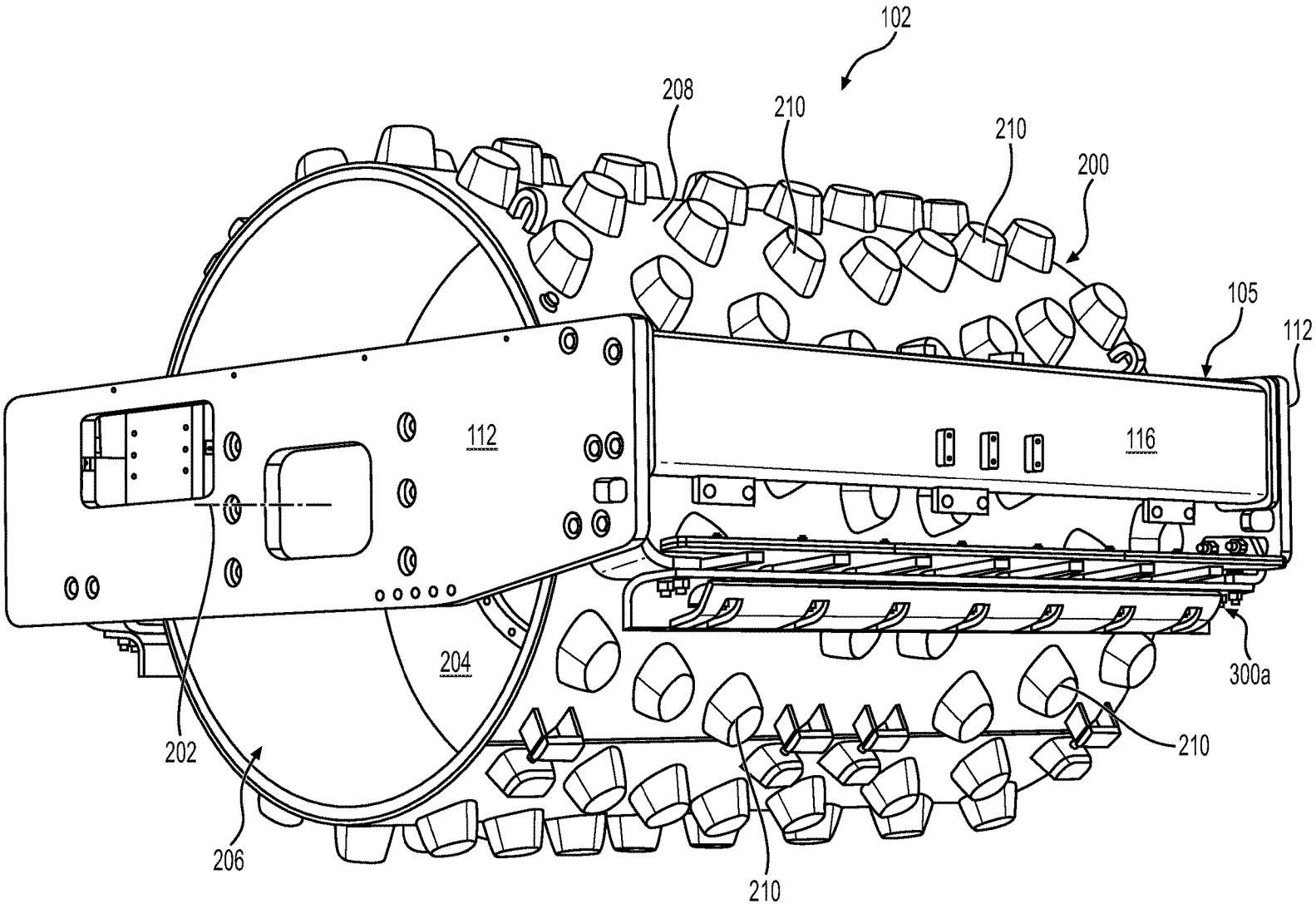
FIG. 6 is an alternate perspective view of the drum assembly as well as a secondary cleaning bar(s) of FIG. 3.

Looking at FIGS. 3, 5, and 6, the compactor drum assembly 200 may include a central disc 204 (may also be referred to as a hub), a drum member 206 wrapped around the central disc 204 forming an outer circumferential surface 208, and a plurality of pads or cleats 210 attached to the outer circumferential surface 208. In other embodiments, the pads or cleats may be omitted. A plurality of scrapers 400 etc., are positioned axially between the plurality of pads or cleats 210 (see also FIG. 2). The scrapers may be employed even when the pads or cleats are omitted to remove debris, etc. from the outer circumferential surface of the drum.

Referring to FIGS. 2 thru 6, the yoke subassembly 105 may include a pair of side plates 112, a rear frame tube member 114 that is attached to the pair of side plates 112, and a front frame tube member 116 that is attached to the pair of side plates 112. Also, the yoke subassembly 105 may further comprise a hitch portion 117 that is connected to the rear frame tube member 114. This hitch portion may include a bearing portion 118 and pin connections (see 122) on either side of the bearing axis 120. Though not shown, the vibration system may be part of the compactor drum assembly itself, or may be omitted altogether. As shown in FIG. 1, the hitch portion 117 may be attached to the frame 104 of the machine 100.

As best seen in FIGS. 4 and 5, the scraper subassembly 300 may be attached to the pair of side plates 112 below rear frame tube member 114. A plurality of top mounting blocks 302 each with at least two mounting apertures 305, a top mounting plate 304 that includes a top portion 306 and a front flange 308, and a bottom guard plate 310 that includes a rear portion 312 and a bottom flange 314 that defines a series of slots 316 may also be provided that are configured to allow attachment of a plurality of bottom mounting blocks 318. Each of the bottom mounting blocks 318 may be configured to fit within the slots 316 for assembly. Also, each may define at least two mounting holes 320 that are configured to align with the two mounting apertures 305 of each of the plurality of top mounting blocks 302. These apertures 305 may or may not be tapped, while the mounting holes 320 may be clearance holes and may or may not include counterbores for receiving the heads of fasteners.

Still referring to FIGS. 4 and 5, it can be understood that the series of slots 316 are each wide enough to receive one of the bottom mounting blocks 318, and that the bottom flange 314 of the bottom guard plate 310 is disposed adjacent to the front flange 308 of the top mounting plate 304. Thus, an enclosure is substantially formed about the attachment structure of the scraper subassembly.

This attachment structure may be described as follows. At least one of the plurality of scrapers 400 may be trapped below one of the plurality of top mounting blocks 302, and above the top mounting plate 304. One of the plurality of bottom mounting blocks 318 may be disposed below the top mounting plate 304, and may be fastened to the one of the plurality of top mounting blocks 302.

Figure 7:
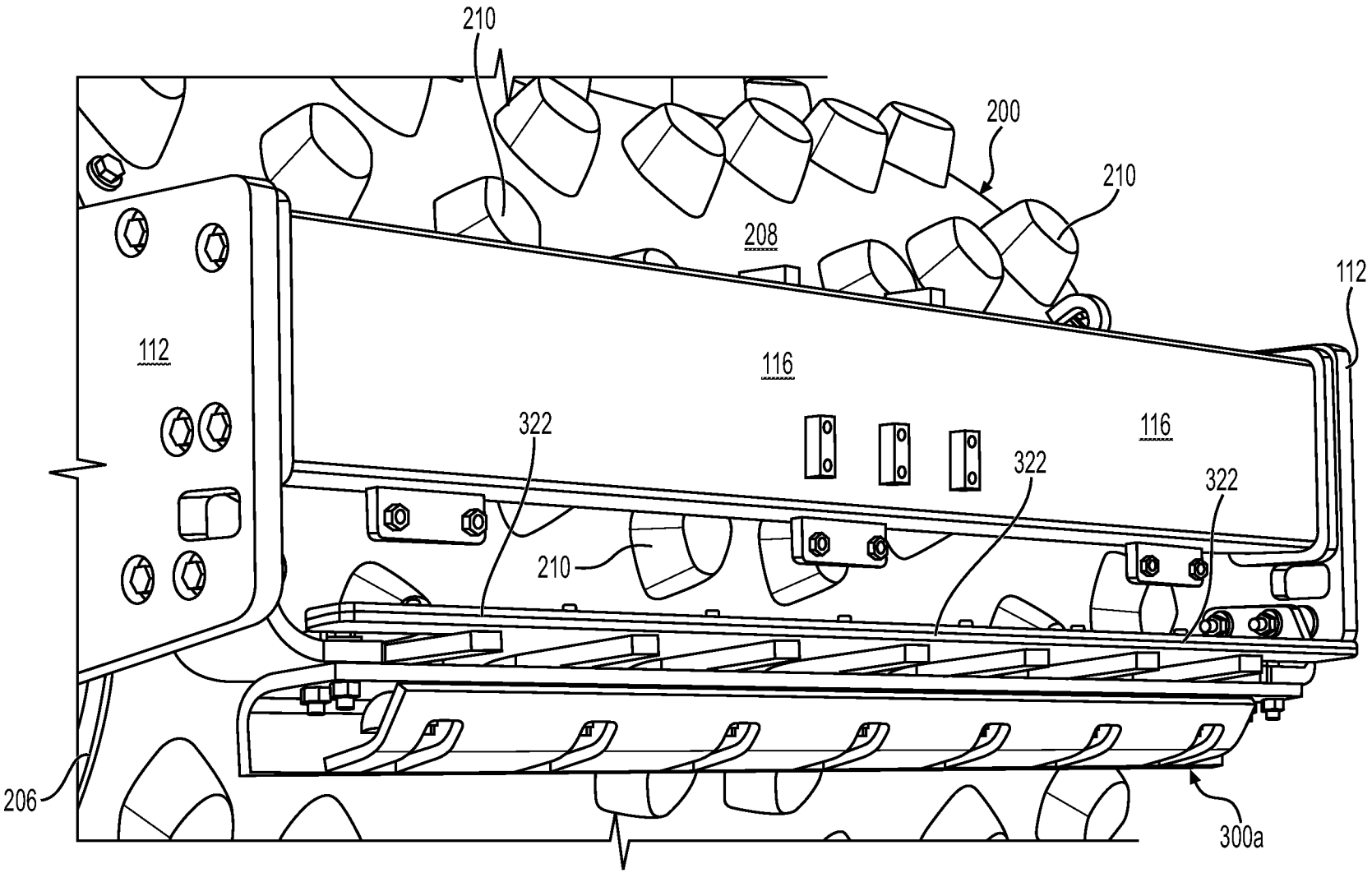
FIG. 7 is an enlarged detail view of the drum assembly and secondary cleaning bar(s) of FIG. 6.
Figure 8:
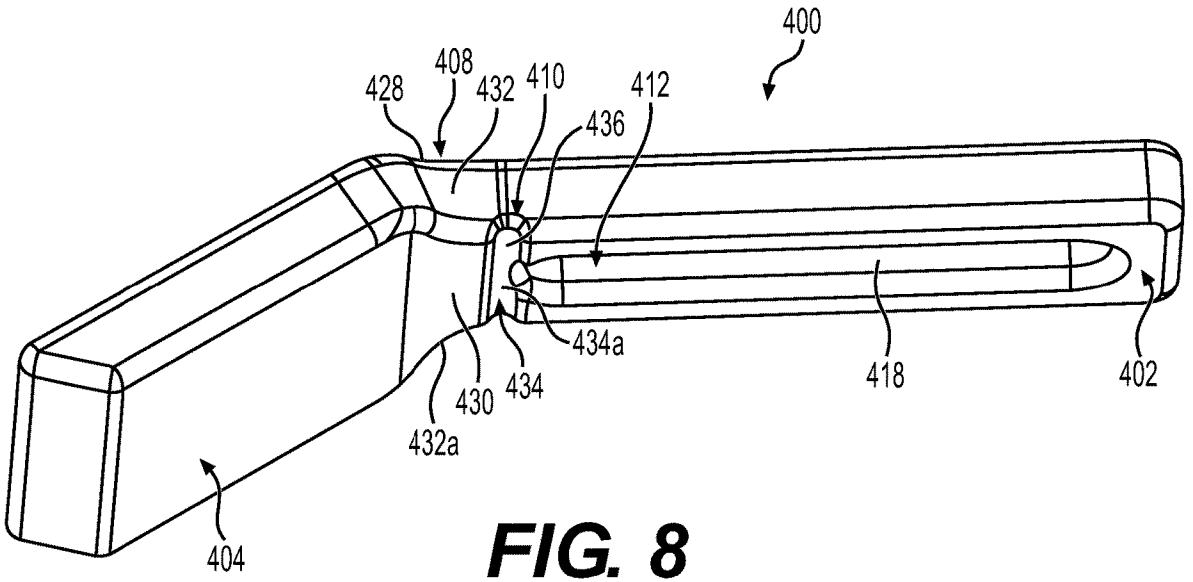
FIG. 8 is a perspective view of a cleaner finger or scraper with an arcuate slot extending along the width of its necked down region according to a first embodiment of the present disclosure.

Referring now to FIGS. 2, 6 and 7, a secondary cleaning subassembly 300*a* that is similarly or identically configured to the scraper subassembly 300 about a vertical plane 212 that passes through the axis of rotation 202 may be provided in some embodiments. In some embodiments, the second cleaning subassembly 300*a* may also including a plurality of U-shaped plates 322 that each define a slot 324 large enough to receive or allow to pass through at least one of the plurality of pads or cleats 210. These plates 322 or the scrapers 400 may be omitted in some embodiments. In other embodiments, the secondary cleaning subassembly may be omitted altogether.

In addition, a linear array of a single scraper repeated at intervals is shown for subassemblies 300, 300*a*. However, it is contemplated that stacks of scrapers that are repeated as part of a linear array is possible in other embodiments of the present disclosure.

Next, various embodiments of a scraper that may be used with the assemblies and subassemblies described above will be discussed in detail with reference to FIGS. 8 thru 15. These embodiments of a scraper may be provided as a replacement part or part of a replacement part kit as will be discussed in further detail later herein.

In FIGS. 8 thru 15, the various embodiments of a scraper 400, 500, 600, 700 may comprise an attachment portion 402, 502, 602, 702, a scraping portion 404, 504, 604, 704 that forms a first oblique angle 406, 506, with the attachment portion 402, 502, 602, 702, and a transition portion 408, 508, 608, 708 connecting the scraping portion to the attachment portion. The transition portion may define a stress concentrator 410, 510, 610, 710. The stress concentrator may be configured to allow the scraper to break before any structure to which the scraper is attached is damaged.

The attachment portion 402, 502, 602, 702 may be attached to the subassemblies 300, 300*a* by welding, fastening, etc. Often, fastening is employed to facilitate replacement of the scraper 400, 500, 600, 700. In such a case, the attachment portion 402, 502, 602, 702 defines a fastener receiving aperture 412, 512, 612, 712. One or more fastener receiving apertures may be provided that may be shaped as a cylindrical hole(s) or an elongated slot, etc.

In FIGS. 10, and 13 thru 15, in some embodiments the attachment portion 402, 502, 602, 702 includes a rectangular configuration defining a length 414, 514, 614, 714, and a width 416, 516, 616, 716 that is less than the length 414, 514, 614, 714. In such an embodiment, the fastener receiving aperture 412, 512, 612, 712 may take the form of an elongated slot 418, 518, 618, 718 that runs parallel with the length 414, 514, 614, 714 of the attachment portion 402, 502, 602, 702.

Figure 9:
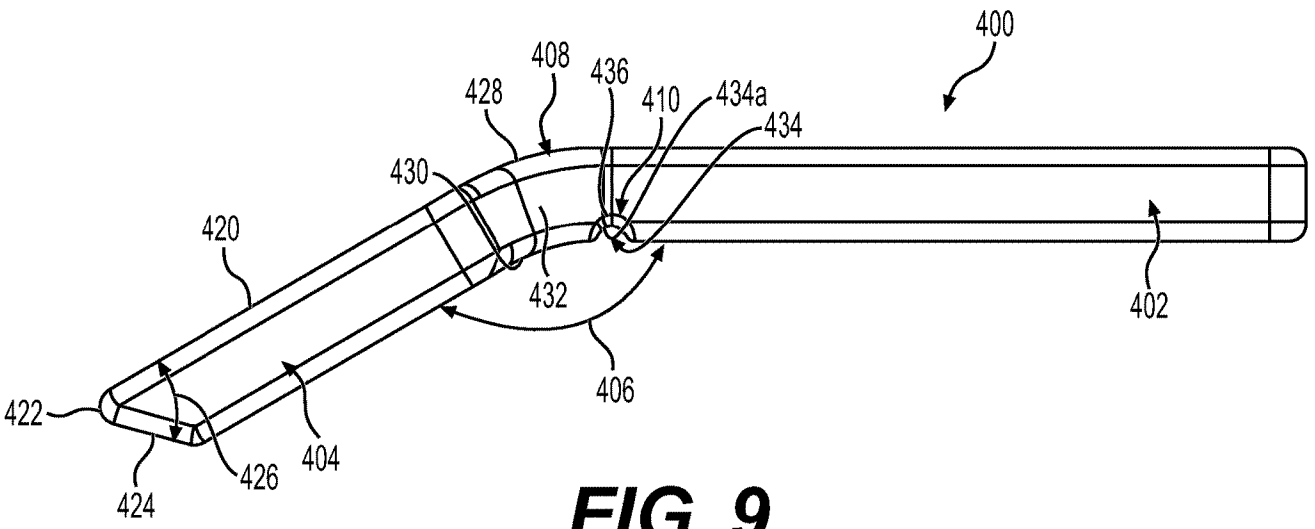
FIG. 9 is a side view of the cleaner finger or scraper of FIG. 8.
Figure 10:
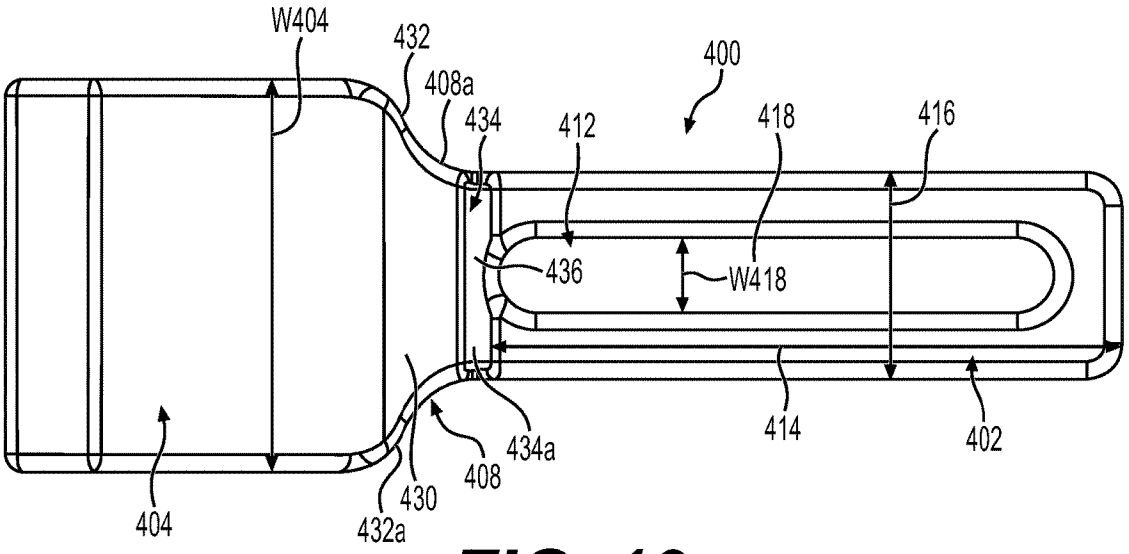
FIG. 10 is a bottom view of the cleaner finger or scraper of FIG. 8.
Figure 11:
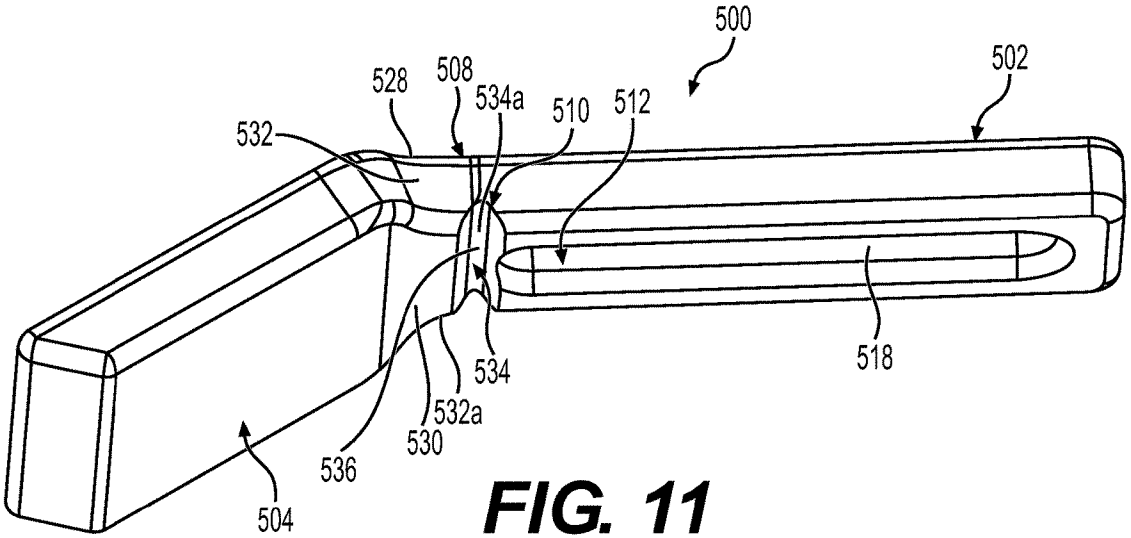
FIG. 11 is a perspective view of a cleaner finger or scraper with a V-notch extending along the width of its necked down region according to a second embodiment of the present disclosure.
Figure 12:
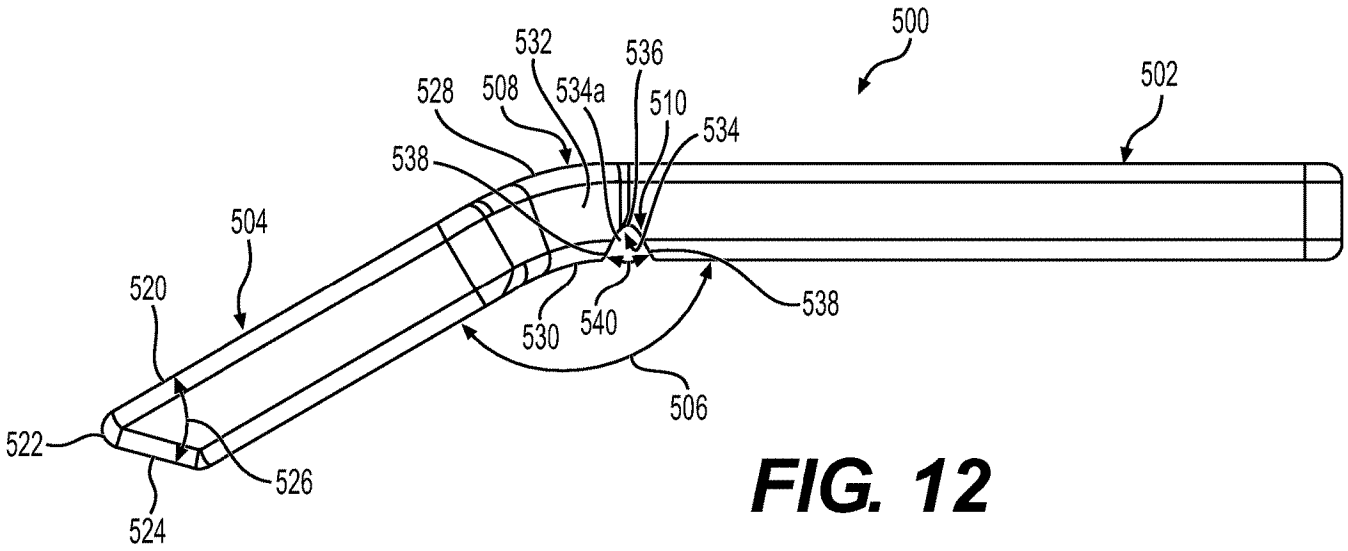
FIG. 12 is a side view of the cleaner finger or the scraper of FIG. 11.
Figure 13:
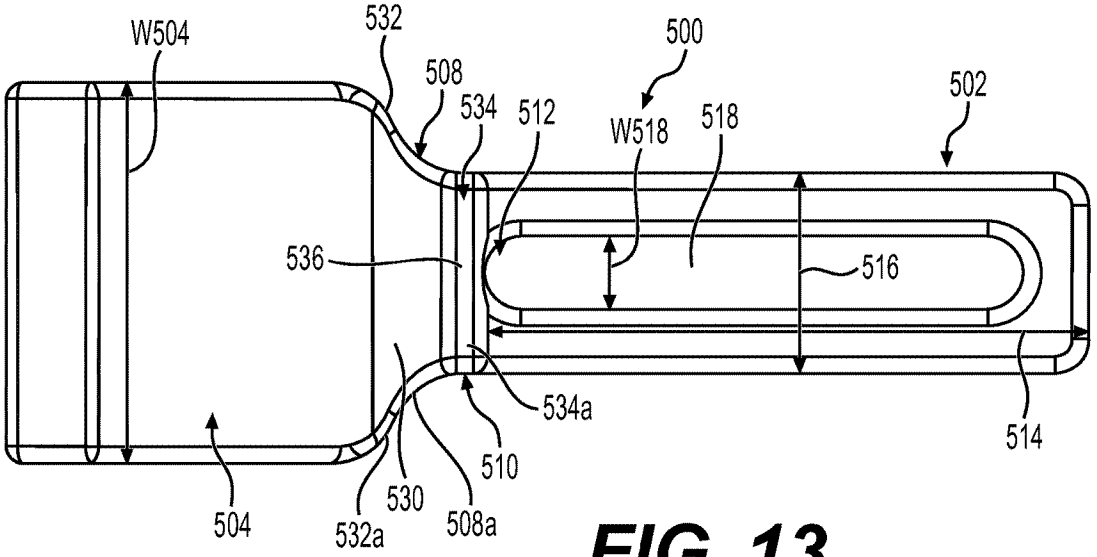
FIG. 13 is a bottom view of the cleaner finger or scarper of FIG. 11.

Looking at FIGS. 9 and 12, in some embodiments the scraping portion 404, 504 includes a top surface 420, 520, defines a free end 422, 522, and further includes an end sloped surface 424, 524 that forms a second oblique angle 426, 526 with the top surface 420, 520. As shown, the top surface 420, 520 may be disposed adjacent to the free end 422, 522. Scrapers 500, 600 are similarly or identically constructed in this area. Other configurations are possible including providing an arcuate end surface to match the curvature of the drum, etc.

As shown, the thickness of the scrapers is consistent from the scraping portion to the attachment portion (see FIGS. 9 and 12). However, this may not always be the case for other embodiments of the present disclosure.

As just alluded to herein, various configurations for the transition portion are possible. In FIGS. 10, and 13 thru 15, the transition portion 408, 508, 608, 708 may include a laterally necked down region 408*a*, 508*a*, 608*a*, 708*a* such that the scraping portion 404, 504, 604, 704 defines a scraping portion width W404, W504, W604, W704, while the attachment portion 402, 502, 602, 702 defines an attachment portion width (e.g., see 416, 516, 616, 716) that is less than the scraping portion width W404, W504, W604, W704. In other embodiments, the transition portion may also neck down vertically in addition to, or in lieu, of necking down laterally.

Referring to FIGS. 8 thru 15, the laterally necked down region 408*a*, 508*a*, 608*a*, 708*a* may include an upper surface 428, 528, a lower surface 430, 530, 630, 730, a first side surface 432, 532, 632, 732, and a second side surface 432*a*, 532*a*, 632*a*, 732*a*.

In FIGS. 8 thru 13, the stress concentrator 410, 510 may take the form of a lower aperture 434, 534 that is defined by the lower surface 430, 530, the lower aperture 434, 534 may take the form of a groove 434*a*, 534*a* that extends completely through the laterally necked down region 408*a*, 508*a* from the first side surface 432, 532 to the second side surface 432*a*, 532*a*. A blind aperture may be employed in other embodiments of the present disclosure.

The placement of the groove at this location allows the tensile stresses to be focused and concentrated given the direction 214 of the drum in FIG. 5. So, the effects of tuning can be maximized. To that end, the groove 434*a*, 534*a* may define an arcuate bottom surface 436, 536. The smaller the radius (i.e., as it approaches a sharp point), the greater the concentration of tensile stresses. In FIG. 12, the groove 534*a* defines angled sidewalls 538 that form an acute angle 540 with each other. This angle 540 can also be adjusted to concentrate or decrease the tensile stresses. The depths of the grooves as well as their location along the laterally necked down region may also affect the tensile stresses.

Alternatively, the groove may be placed on the top surface, or on the top and bottom surfaces simultaneously, taken advantage of compressive stresses as well when fine tuning the performance of the scraper.

Figure 17:
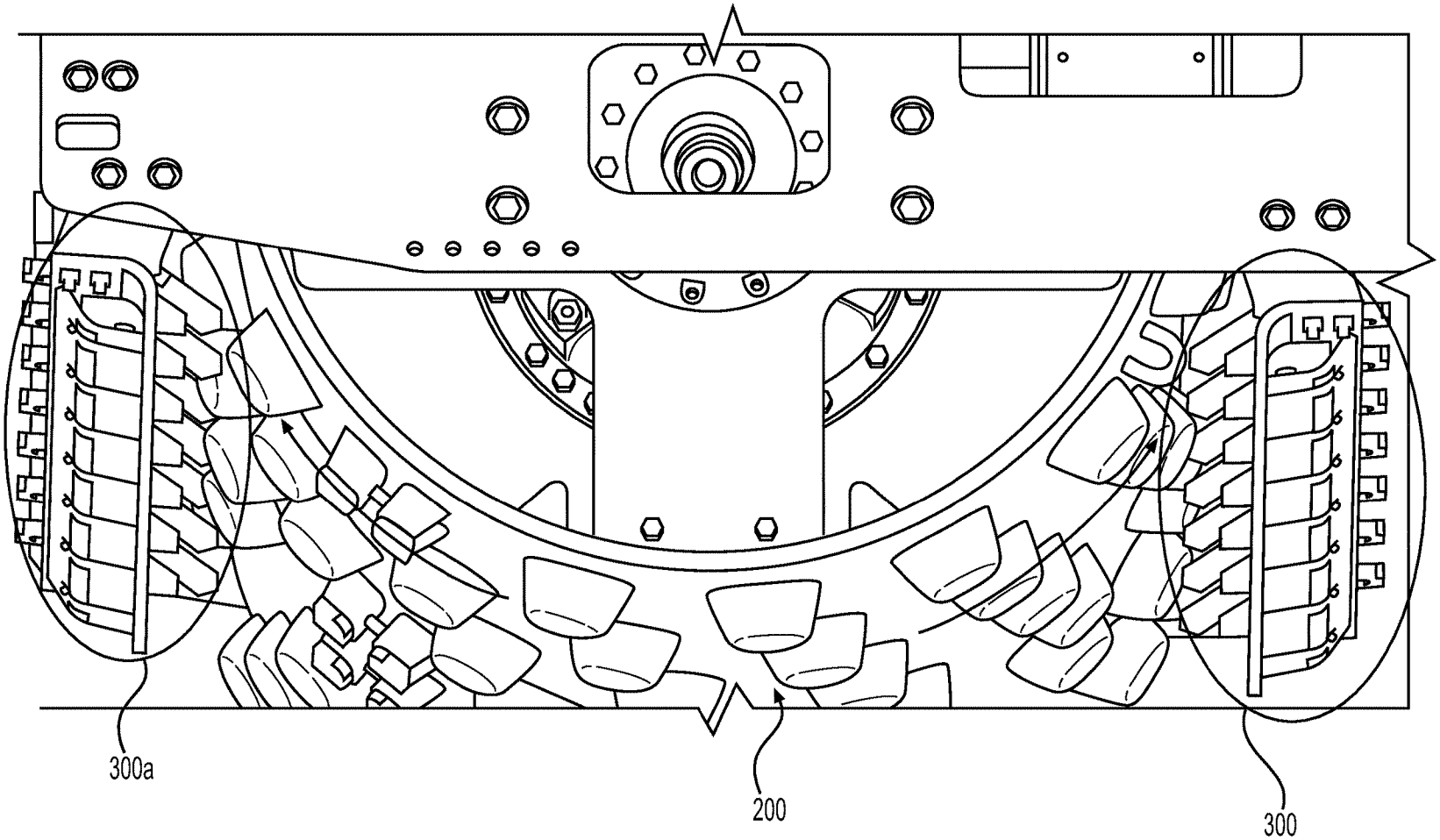
FIG. 17 illustrates how using two oppositely arranged cleaner finger assemblies allows the drum to reverse rotation and still be cleaned properly.

Moreover as shown in FIG. 17, essentially the same scraper supporting structure 300 may also be installed on the front of the machine. Those scrapers are of primary use when the drum direction 214 is reversed.

For example in FIGS. 8 thru 15, the stress concentrators 410, 510, 610, 710 are disposed adjacent (e.g., within 5.0 mm along the length of the attachment portion) of the fastener receiving aperture 412, 512, 612, 712.

Figure 14:
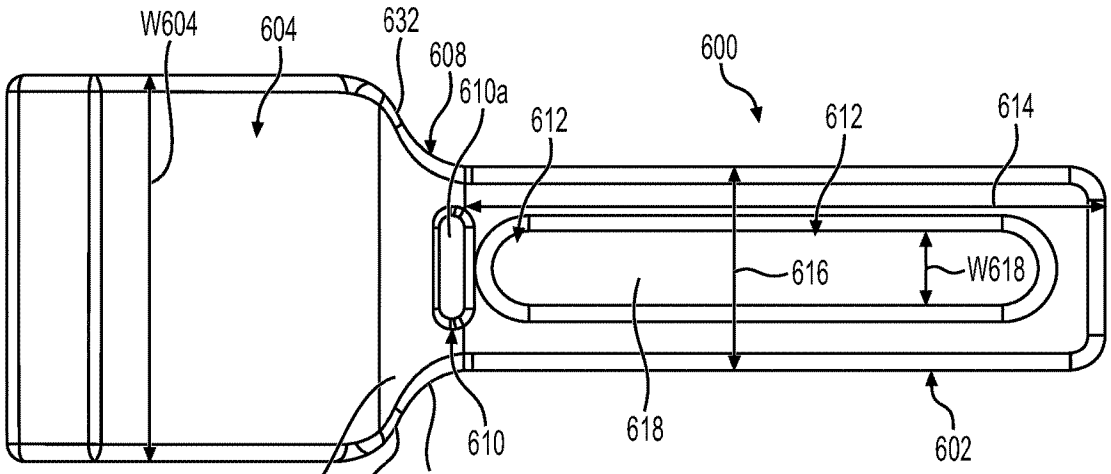
FIG. 14 is a bottom view of a cleaner finger or a scraper with an aperture extending within its necked down region according to a third embodiment of the present disclosure.

In FIG. 14, the stress concentrator 610 is a slot 610*a* that extends over half of the attachment portion width 616 (e.g., may be equal to or greater than the width W618 of the elongated slot 618). The slot 610*a* is disposed adjacent an end of a fastener receiving aperture 612 as just alluded to herein. The slot 610*a* may extend completely through the laterally necked down region 608*a* from the upper surface to the lower surface 630.

Figure 15:
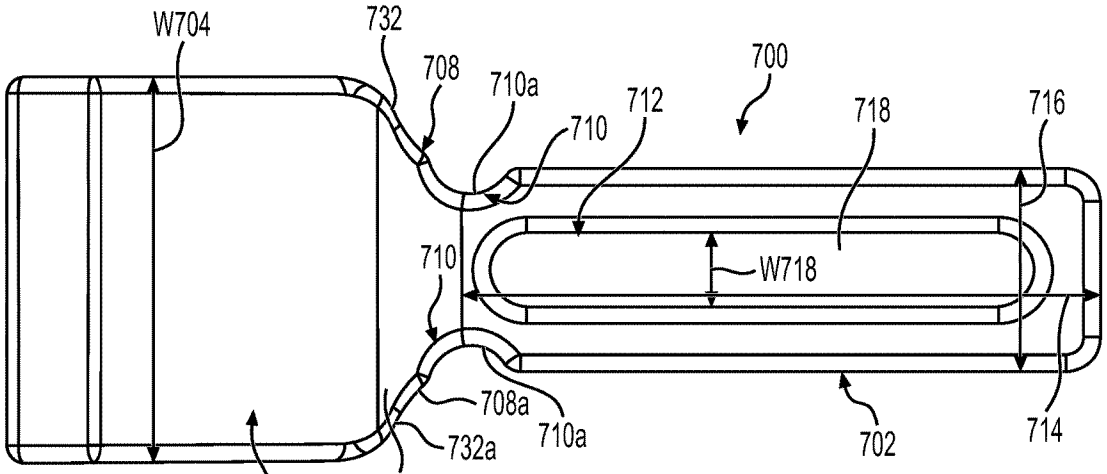
FIG. 15 is a bottom view of a cleaner finger or a scraper with side notches having an arcuate profile disposed on either side of its necked down region according to a fourth embodiment of the present disclosure.

In FIG. 15, the stress concentrator 710 is a groove 710*a* that extends along the first side surface 732 or the second side surface 732*a* (or both as shown), completely through the laterally necked down region 708*a*. The groove 710*a* may bleed into the attachment portion 702 along the length 714 of the attachment portion 702, past the end of the elongated slot 718. Other configurations are possible in other embodiments of the present disclosure.

The mounting blocks, mounting plates, U-shaped plates, and scrapers may be cast or molded from any suitable material including, but not limited to, steel, aluminum, iron, cast-iron, grey cast-iron, and thermoplastics. The mounting plates may be bent using a brake press or a progressive die operation, etc. The mounting blocks may be machine, etc.

Any of the dimensions, configurations, materials, etc. discussed herein may be varied as needed or desired to be different than any value or characteristic specifically mentioned herein or shown in the drawings for any of the embodiments.

INDUSTRIAL APPLICABILITY

In practice, a compactor machine, a yoke assembly, a compactor wheel assembly, a scraper subassembly, a secondary cleaning subassembly and/or a scraper or replacement kit (which will be discussed in detail momentarily herein) constructed according any embodiment disclosed herein may be sold, bought, manufactured or otherwise obtained in an OEM (original equipment manufacturer) or after-market context. In some cases, various components, of the scraper subassembly or secondary cleaning subassembly, etc. may be provided as a kit to repair or retrofit a machine in the field.

The design intent of the stress concentrator of the scraper is to cause failure in the part prior to any damaging occurring in the scraper mounting structure. The stress concentrator may be tuned for the desired loading condition, the geometry of the scraper, the material of the scraper, the manufacturing method of the scraper, and the design of the attachment structure. The stress concentrator may be a combination of features of varying geometry and location on the scraper. The features may be continuous or non-continuous. The properly designed geometric feature will result in the scraper only failing just prior to when damage would occur in the scraper mounting structure. This may minimize the number of instances in which the scraper needs to be replaced in service as well as help to avoid the costly repair of the scraper mounting structure.

A replacement kit for a cleaner finger assembly as described herein may include a scraper 400, 500, 600, 700 including an attachment portion 402, 502, 602, 702 that defines an elongated fastener receiving slot (e.g. see 418, 518, 618, 718, and a scraping portion 404, 504, 604, 704 that forms a first oblique angle 406, 506 with the attachment portion. A transition portion 408, 608, 708, 808 may connect the scraping portion to the attachment portion that has a stress concentrator 410, 510, 610, 710. The elongated fastener receiving slot runs parallel with the length 414, 514, 614, 714 of the attachment portion 402, 502, 602, 702, and defines a slot width W418, W518, W618, W718.

As best understood with reference to FIG. 2, a top mounting block(s) 302 may be provided that defines a top mounting block width W302 that is greater than the slot width W418, W518, W618, W718 so it can press onto the scraper properly (may be about the same or greater than the width of the attachment portion of the scraper, see 416, 516, 716, 816). Two apertures (e.g., 305) may extend through the top mounting block 302 (as well as a top mounting plate 304).

A top mounting plate 304 may be provided that includes a top portion 306 and a front flange 308, as well as a bottom guard plate 310 that includes a rear portion 312 and a bottom flange 314 that defines a series of slots 316. A bottom mounting block(s) 318 may be part of the kit that defines two holes (e.g., 320) that are configured to align with the two apertures of the top mounting block. This may allow fasteners to extend through the bottom mounting block, the top mounting plate, the scraper, and the top mounting block. Once the fasteners are tightened, all the components including the scraper will not move.

Figure 18:
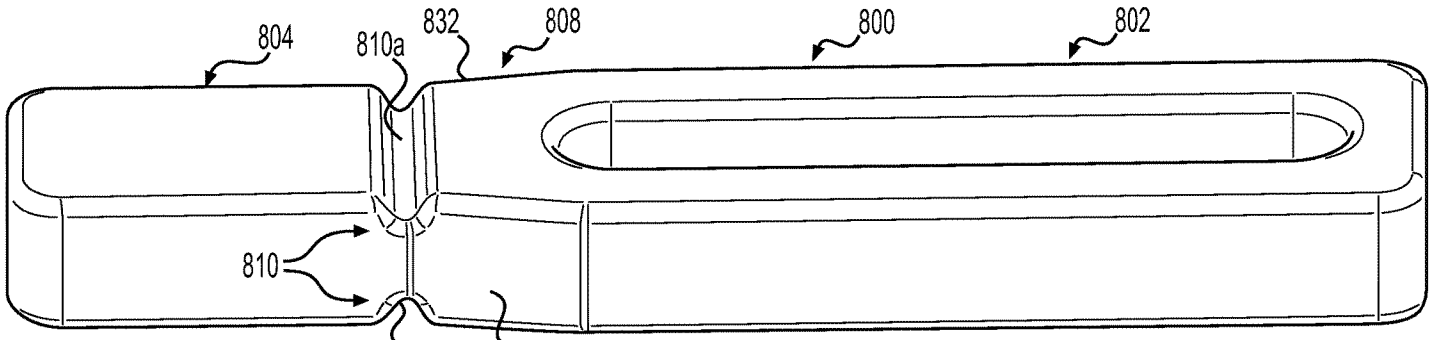
FIG. 18 is a perspective view of another embodiment of the scraper that is straight, has a consistent thickness, and has a wider mounting portion than the scraping portion
Figure 19:
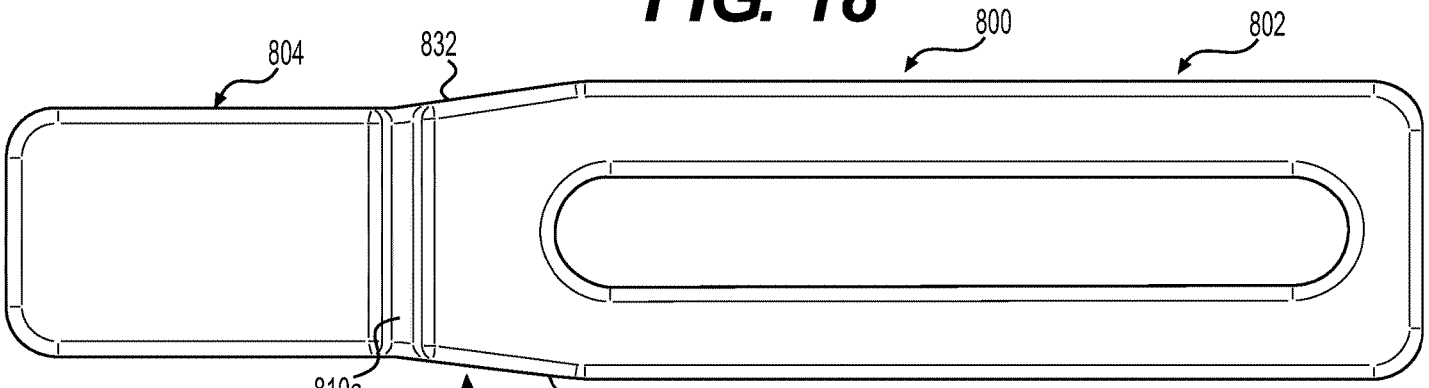
FIG. 19 is a top view of the scraper of FIG. 18.
Figure 20:
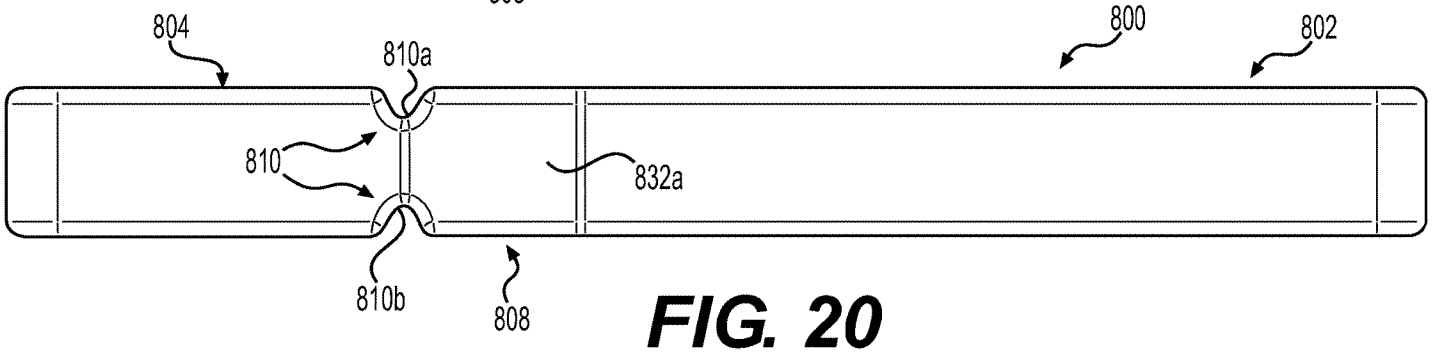
FIG. 20 is a side view of the scraper of FIG. 18

FIGS. 18 thru 20 illustrate yet another embodiments of a scraper 800 that is differently configured than the previous scrapers described herein. The scraper comprises an attachment portion 802 with a width W802 that is wider than the width W804 of the scraper portion 804.

The transition portion 808 comprises a horizontally necked down region with angled side surfaces 832, 832*a* tapering from the mounting portion to the scraping portion, instead of the vice versa as shown in the previous scrapers.

The stress concentrator 810 may comprise a top groove 810*a* and/or a bottom groove 810*b* disposed on the upper surface 829 or the lower surface 830 of the transition portion.

Again, other embodiments and configurations of the scraper are contemplated herein and are intended to be within the scope of the present application. For example, the necked down or transition regions of various scrapers may be omitted in some cases.

As used herein, the articles "a" and "an" are intended to include one or more items, and may be used interchangeably with "one or more." Where only one item is intended, the term "one" or similar language is used. Also, as used herein, the terms "has", "have", "having", "with" or the like are intended to be open-ended terms. Further, the phrase "based on" is intended to mean "based, at least in part, on" unless explicitly stated otherwise.

Recitation of ranges of values herein are merely intended to serve as a shorthand method of referring individually to each separate value falling within the range, unless otherwise indicated herein, and each separate value is incorporated into the specification as if it were individually recited herein.

It will be apparent to those skilled in the art that various modifications and variations can be made to the embodiments of the apparatus and methods of assembly as discussed herein without departing from the scope or spirit of the invention(s). Other embodiments of this disclosure will be apparent to those skilled in the art from consideration of the specification and practice of the various embodiments disclosed herein. For example, some of the equipment may be constructed and function differently than what has been described herein and certain steps of any method may be omitted, performed in an order that is different than what has been specifically mentioned or in some cases performed simultaneously or in sub-steps. Furthermore, variations or modifications to certain aspects or features of various embodiments may be made to create further embodiments and features and aspects of various embodiments may be added to or substituted for other features or aspects of other embodiments in order to provide still further embodiments.

Accordingly, it is intended that the specification and examples be considered as exemplary only, with a true scope and spirit of the invention(s) being indicated by the following claims and their equivalents.

What is claimed is:

1. A scraper for use with a compactor wheel assembly, the scraper comprising:

an attachment portion;

a scraping portion; and a transition portion connecting the scraping portion to the attachment portion, the transition portion defining a stress concentrator that is configured to cause the scraper to break, wherein the transition portion includes an upper surface, a lower surface, a first side surface, and a second side surface, and wherein the stress concentrator is a groove defined by the lower surface and extending from the first side surface to the second side surface.

2. The scraper of claim 1, wherein the attachment portion defines a fastener receiving aperture.

3. The scraper of claim 2, wherein the attachment portion includes a rectangular configuration defining a length and a width that is less than the length, and the fastener receiving aperture is an elongated slot that runs parallel with the length of the attachment portion.

4. The scraper of claim 1, wherein the scraping portion forms a first oblique angle with the attachment portion, and the scraping portion includes a top surface, defines a free end, and further includes an end sloped surface that forms a second oblique angle with the top surface that is disposed adjacent to the free end.

5. The scraper of claim 1, wherein the scraping portion forms a first oblique angle with the attachment portion, the transition portion includes a laterally necked down region such that the scraping portion defines a scraping portion width, and the attachment portion defines an attachment portion width that is less than the scraping portion width.

6. The scraper of claim 5, wherein the groove extends through the laterally necked down region from the first side surface to the second side surface.

7. The scraper of claim 1, wherein the groove defines an arcuate bottom surface.

8. The scraper of claim 1, wherein the groove defines angled sidewalls that form an acute angle with each other.

9. A compactor wheel assembly comprising:

a yoke subassembly;

a compactor drum subassembly that is rotatably attached to the yoke subassembly about an axis of rotation; and a scraper subassembly that is attached to the yoke subassembly proximate to the compactor drum subassembly;

wherein the scraper subassembly includes a plurality of scrapers, each of the plurality of scrapers including:

an attachment portion, a scraping portion that forms a first oblique angle with the attachment portion, and a transition portion connecting the scraping portion to the attachment portion, the transition portion defining a stress concentrator, wherein the transition portion includes an upper surface, a lower surface, a first side surface, and a second side surface, wherein the stress concentrator includes a groove defined by the upper surface or the lower surface, and wherein the groove extends from the first side surface to the second side surface.

10. The compactor wheel assembly of claim 9, wherein compactor drum assembly includes:

a central disc, a drum member wrapped around the central disc forming an outer circumferential surface, and a plurality of pads or cleats attached to the outer circumferential surface; and wherein the plurality of scrapers are positioned axially between the plurality of pads or cleats.

11. The compactor wheel assembly of claim 9, wherein the yoke subassembly includes:

a pair of side plates, a rear frame tube member attached to the pair of side plates, and a front frame tube member that is attached to the pair of side plates.

12. The compactor wheel assembly of claim 11, wherein the yoke subassembly further comprises:

a hitch portion that is connected to the rear frame tube member; and wherein the scraper subassembly is attached to the pair of side plates below the rear frame tube member.

13. The compactor wheel assembly of claim 12, wherein the scraper subassembly further comprises:

a plurality of top mounting blocks, each of the plurality of top mounting blocks including:

at least two mounting apertures, a top mounting plate that includes a front flange, and a bottom guard plate that includes a bottom flange and defines a series of slots; and a plurality of bottom mounting blocks that each define at least two mounting holes that are configured to align with the two mounting apertures of each of the plurality of top mounting blocks.

14. The compactor wheel assembly of claim 13, wherein the series of slots are each wide enough to receive one of the bottom mounting blocks, and the bottom flange of the bottom guard plate is adjacent to the front flange of the top mounting plate.

15. The compactor wheel assembly of claim 14, wherein at least one of the plurality of scrapers is trapped below one of the plurality of top mounting blocks and above the top mounting plate, and one of the plurality of bottom mounting blocks is fastened to the one of the plurality of top mounting blocks.

16. The compactor wheel assembly of claim 10, further comprising a secondary cleaning subassembly including a plurality of U-shaped plates that each define a slot large enough to receive at least one of the plurality of pads or cleats.

17. A scraper for use with a compactor wheel assembly, the scraper comprising:

an attachment portion;

a scraping portion; and a transition portion connecting the scraping portion to the attachment portion, the transition portion defining a stress concentrator that is configured to cause the scraper to break, wherein the transition portion includes an upper surface, a lower surface, a first side surface, and a second side surface, and wherein the stress concentrator includes a groove defined by the upper surface and extending from the first side surface to the second side surface.

18. The scraper of claim 17, wherein the groove is a first groove, and wherein the stress concentrator further includes a second groove defined by the lower surface and extending from the first side surface to the second side surface.

19. The scraper of claim 17, wherein the scraping portion forms an oblique angle with the attachment portion.

20. The scraper of claim 17, wherein the attachment portion includes an elongated slot.

* * * * *